US006926256B2

(12) United States Patent
Shah et al.

(10) Patent No.: US 6,926,256 B2
(45) Date of Patent: Aug. 9, 2005

(54) CENTER SILL CAR JACK UTILIZING AIR BELLOWS

(75) Inventors: Jack K. Shah, Lombard, IL (US); T. Michael Benson, New Berlin, WI (US)

(73) Assignee: TIX Company, Chicago, IL (US)

( * ) Notice: Subject to any disclaimer, the term of this patent is extended or adjusted under 35 U.S.C. 154(b) by 54 days.

(21) Appl. No.: 10/404,001

(22) Filed: Mar. 31, 2003

(65) Prior Publication Data

US 2004/0188662 A1 Sep. 30, 2004

(51) Int. Cl.[7] ..... B66F 3/35
(52) U.S. Cl. ..... 254/89 H; 254/93 HP
(58) Field of Search ..... 254/93 HP, 89 H, 254/93 H, 93 VA

(56) References Cited

U.S. PATENT DOCUMENTS

| | | | | |
|---|---|---|---|---|
| 1,528,857 A | | 3/1925 | Strandberg et al. | |
| 1,745,959 A | * | 2/1930 | Steiner | 92/44 |
| 3,570,812 A | | 3/1971 | Finkbeiner | |
| 3,730,366 A | * | 5/1973 | Berends | 414/495 |
| 4,275,869 A | * | 6/1981 | Clements | 254/89 H |
| 4,319,666 A | * | 3/1982 | Hunter | 187/204 |
| 4,323,141 A | * | 4/1982 | Ragan et al. | 187/204 |
| 4,397,054 A | * | 8/1983 | Lee, Jr. | 82/164 |
| 4,461,455 A | | 7/1984 | Mills et al. | |
| 4,805,875 A | * | 2/1989 | Jackson et al. | 254/2 R |
| 4,938,305 A | * | 7/1990 | Park | 180/199 |
| 5,133,531 A | | 7/1992 | Grashoff et al. | |

FOREIGN PATENT DOCUMENTS

| | | |
|---|---|---|
| GB | 2213795 | 8/1989 |
| SU | 1232-642 | 5/1986 |
| SU | 1232644 | 5/1986 |
| SU | 1495281 | 7/1989 |

* cited by examiner

*Primary Examiner*—Lee D. Wilson
(74) *Attorney, Agent, or Firm*—Brinks Hofer Gilson & Lione

(57) ABSTRACT

The disclosed jack assembly is used to raise the frame of a railroad car to a sufficient height above a wheeled truck assembly coupled to the railroad car in order to perform maintenance or remove the truck assembly. The jack assembly comprises an air-operated bellows which raises and lowers a plate that engages the railroad car for the raising and lowering action. Telescoping posts and other support members aid in stabilizing the jack assembly during use in order to prevent failure of the bellows due to buckling under the weight of the railroad car. The jack assembly is readily mobile between locations, and can be operated by a single user.

20 Claims, 4 Drawing Sheets

CENTER SILL CAR JACK UTILIZING AIR BELLOWS

FIELD OF THE INVENTION

The present invention relates to the field of lifting devices, and more particularly to a railroad car jack assembly.

BACKGROUND OF THE INVENTION

A typical railroad car has an elongated frame and a pair of wheeled truck assemblies attached to the frame. Each truck assembly is attached to the frame at each end of the car. Each wheeled truck assembly in turn includes flanged wheels that are adapted to roll on a pair of railroad track rails.

With the wheels on the track rails, there may be clearance of only a few inches between the top of the railroad track rails and the underside of the railroad car frame. Routine maintenance may require that the car frame be elevated somewhat in order to increase this clearance. One form of maintenance may require that the railroad car be completely removed from one of the truck assemblies, to allow such truck assembly to be replaced with another. For example, to remove the assembly, the one end of the car may be lifted vertically about 10–25 inches, while the other end of the car remains supported on the other wheeled truck assembly. With the one car end so elevated, both the old and the new truck assemblies can be rolled along the rails. Other forms of maintenance may require a worker to crawl about beneath the car, and this increased clearance would also be beneficial.

One way of lifting one end of the railroad car is by means of a crane. This is done by connecting the lift line of the crane to the car frame, such as at the car coupling. This requires the presence of a high capacity crane that can carry the load of the car, and such a crane will typically be quite large and represent a significant capital investment. Moreover, such a crane may be mounted on a special railroad service car or road vehicle. If the crane limited to rolling along on track rails, it may not be conveniently moved from one site to another. If the crane is on a road vehicle, the crane may be used only at certain rail sites because of its size.

Another way the railroad car can be removed from the wheeled truck assembly is by means of a pair of separate lift jacks, interposed between the underlying rail bed and each side of the car frame. These jacks are relatively inexpensive, and quite portable. However, as the separate jacks bear against the rail bed, special shoring efforts may be needed in order to provide added stability to the jacks and to prevent the jacks from sinking into the rail bed. Moreover, with the jacks on opposite sides of the car, several people may be needed to operate the jacks.

Moreover, there are certain inherent risks with the use of either the crane or paired lift jacks because they bear the entire load of the railroad car during the time the wheeled truck is removed from the car or while someone is under the car for servicing. A crosswind may cause the crane-suspended car to sway, or the paired jack-supported car may topple sideways off of the jacks. This can be both dangerous to personnel and destructive to property. Dangerously, any failure of the crane lift line or of either jack can allow the raised car to fall.

U.S. Pat. No. 4,805,875 ("the '875 patent") discloses a prior art railroad car jack assembly. This patent discloses a pair of rails and a multi-tiered cylindrical power lift system attached to a plate that engages and lifts the railroad car. The '875 patent also discloses a pair of side block bars that engage the railroad car engaging plate after the plate has raised the railroad car. The block bars provide added support to the car when the engaging plate is at the top of the operative range of movement. Both the power lift system and the block bars are actuated by a hydraulic fluid pumping system.

Although providing a substantial improvement over the prior art, the railroad car jack assembly in the '875 patent has some shortcomings, however. For example, the hydraulic pump system used is expensive, heavy and often requires significant maintenance. Also, the hydraulic lift system is raised and lowered in a somewhat long period of time.

Another prior art jack assembly, U.S. Pat. No. 1,745,959, provides a pair of telescoping posts to support the car engaging means so as to prevent the lifting means from buckling and tipping. While a pair of posts can prevent some angular rotation of the car engaging means, it generally acts to prevent such movement in a limited fashion.

The present invention is directed to an improved portable jack assembly that overcomes one or more of the drawbacks as set forth above.

BRIEF SUMMARY OF THE INVENTION

One aspect of the present invention provides a jack assembly that is self contained and relatively lightweight, to be quite portable to different use sites. The disclosed jack assembly may also be operated by one person at almost any rail site.

Another aspect of the present invention provides that the disclosed jack assembly cooperates directly between the track rails and the car frame, providing safe non-yielding, solid metal-to-metal, triangulated support of the railroad car above the track rails, and without the need of braces or supports to be placed on the rail bed surface.

The present invention may consist of a jack assembly having an elongated structural frame member of sufficient length to span between and beyond the spaced railroad track rails to support a railroad car. An air-powered lift means is connected to the frame member, operating a car engaging means that may be moved in a normal direction with respect to the frame member and the track rails. When in a contracted position, the frame member, power lift means and car engaging means have a clearance under the railroad car sufficient to be manipulated into useable position. When in an extended position, the assembly elevates the car engaging means initially against the underside of the railroad car and then lifts the car vertically so as to separate the railroad car from a wheeled truck assembly.

A further embodiment may include a plurality of telescoping posts surrounding the power lift means to provide lateral support while raising and lower the car engaging means. The posts also provide rotational support for the car engaging means, thereby keeping the car engaging means substantially parallel to the frame members.

Another embodiment may include rotating support members that provide additional support to the power lift means. The support members have an abutting relationship with the car engaging means when the power lift means is fully extended to help distribute the load of the railroad car and provide lateral and rotational stability. Air cylinders can be used to actuate the support members between a lowered position and a raised position.

An air source used to activate the power lift means may be mounted as a unitary part of the jack assembly or may be physically separated from the jack assembly, provided there is an operative connection therebetween.

In another embodiment, a method of raising a railroad car is provided. The method comprising the steps of providing a pair of frame members, a power lift means attached to the frame members, a railroad car engaging means and an air source to activate the power lift means. Air pressure from the air source is introduced to the power lift means to extend the power lift means, thereby raising the car engaging means in a vertical direction. Posts are placed around the power lift means and attached to the car engaging means so as to provide lateral and rotational support while raising and lowering the railroad car.

The drawings and detailed description disclose the preferred embodiments in greater detail, along with many of their advantages.

DETAILED DESCRIPTION OF THE PREFERRED EMBODIMENT

Figure 1:
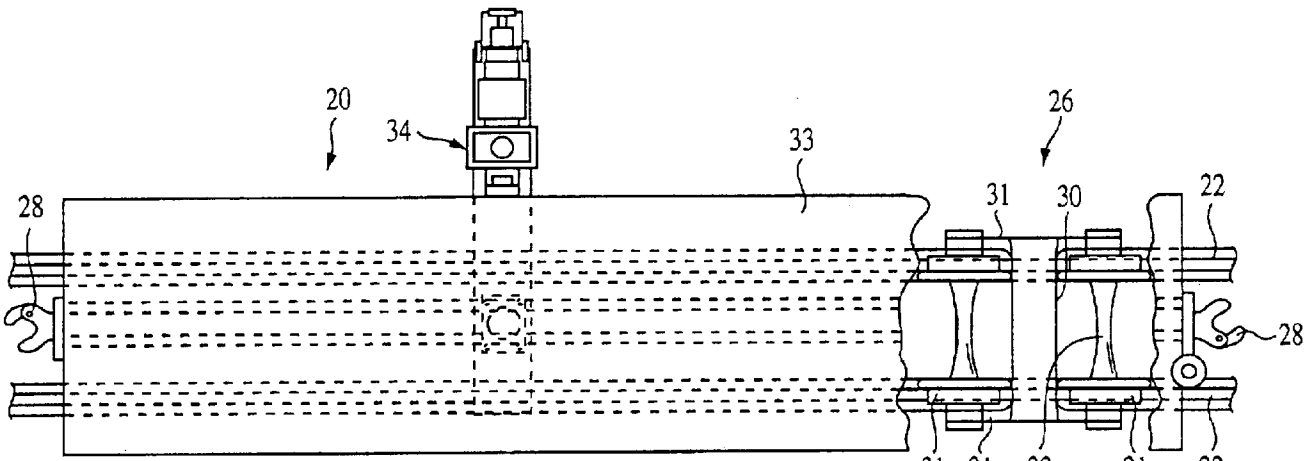
FIG. 1 is a top view of a railroad car, partly broken away for clarity, illustrating one embodiment of the present invention.

FIG. 1 is a top view of the railroad car jack 34 in a preferred operative position beneath a railroad car 20. A section of railroad car flooring 33 has been cut away to show the location of a wheeled truck assembly 26 with respect to the railroad car frame 24 and the railroad track rails 22.

Figure 2:
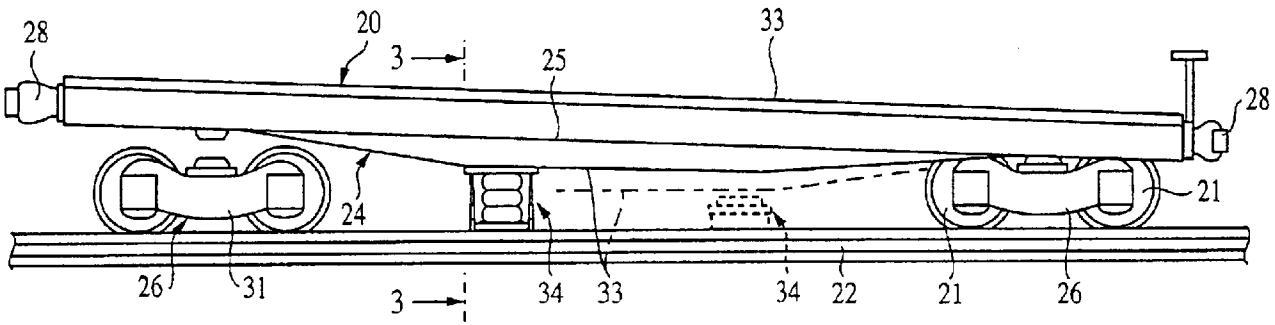
FIG. 2 is a side view of the car and jack assembly illustrated in FIG. 1.
Figure 3:
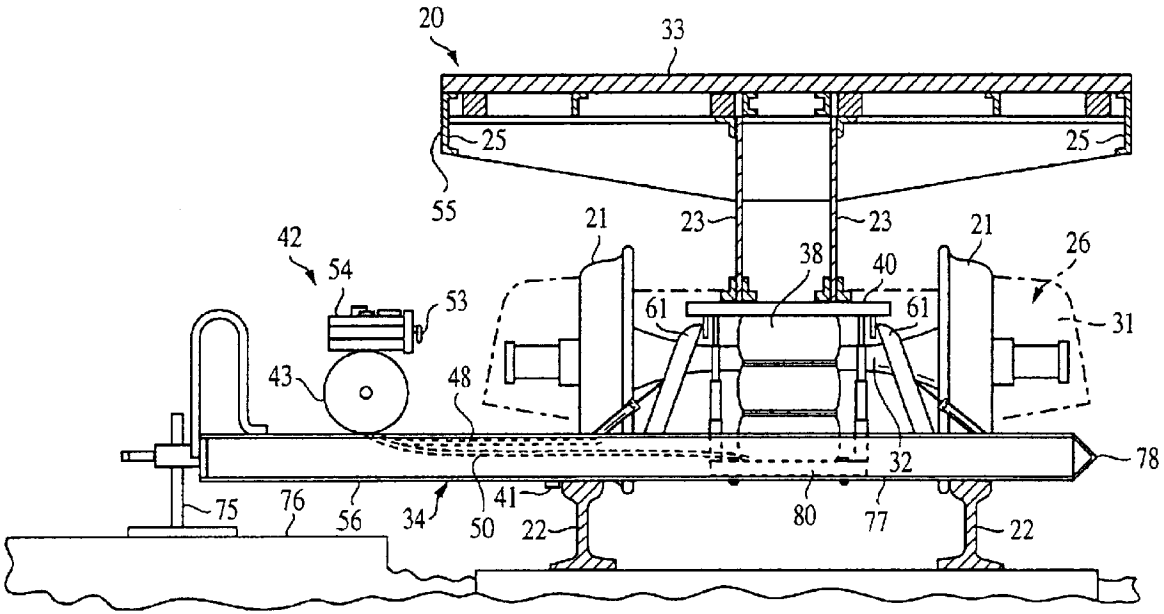
FIG. 3 is an enlarged sectional view, as taken generally from line 3—3 in FIG. 2.
Figure 4:
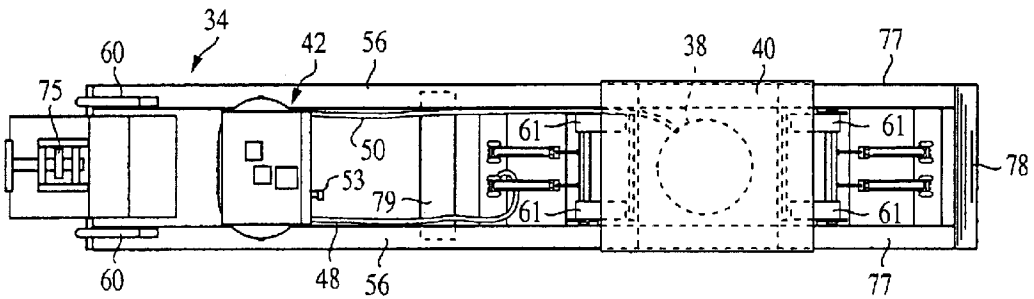
FIG. 4 is a top view of the jack assembly of FIG. 3, with the railroad car eliminated for clarity.

In a first embodiment, a flat-bed railroad car 20, as illustrated in FIGS. 1, 2 and 3, has flanged wheels 21 adapted to roll on two laterally spaced track rails 22. The railroad car 20 has a frame 24 including a central sill 23 and side channels 25, each elongated in the direction of the track rails 22. A wheeled truck assembly 26 is connected to the central sill 23 of the frame 24 at each end of the railroad car 20. Couplings 28 are connected to the frame 24 at the opposite ends of the car 20.

Each wheeled truck assembly 26 includes a cross member 30 and a pair of side frame members 31. The cross member 30 is coupled at its ends through spring and snubbing means (not shown) to the side frame members 31. One flanged wheel 21 is fixed adjacent each end of axle 32, and two such axles 32 are mounted in bearings (not shown) carried in the opposite respective side frames 31.

A typical railroad car may be approximately ten feet wide, across the exterior of its side sections 25 or flooring 33. The railroad car 20 rides centered relative the track rails 22, which conventionally may be separated by approximately four and one-half feet. With the wheels 21 on the track rails 22, there may be only about 10 inches of vertical clearance between the tops of the track rails 22 and the underside of the railroad car frame 24 at the central sill 23.

The jack assembly 34, to be discussed further herein, may be used to lift the railroad car frame 24. For example, the railroad car frame 24 may be lifted completely off of a single wheeled truck assembly 26 as shown in FIG. 2. The jack assembly 34 is placed between the wheeled truck assemblies 26, usually closer to one wheeled truck assembly 26 while still being able to engage the central sill 23 of the frame 24. The operative position of the jack assembly 34 is preferably where the car engaging means 40 can engage the central sill 23, and where the central sill 23 is substantially parallel to the underlying track rails 22. In the operative position, the car engaging means 40 can engage the frame 24 and lift the frame 24 to a position spaced above the wheeled truck assembly 26 while the frame 24 remains supported on the opposite wheeled truck assembly 26. Each wheeled truck assembly 26 is self-contained, and can be easily connected to or separated from the railroad car 20. A stop 41 on the frame members 56 may be used to engage one of the track rails 22 so that the car engaging means 40 of the jack assembly 34 is centered relative to the track rails 22 and relative to the central sill 23. A foot 75 can be attached to the end of the frame members 56 to be set adjustably in a vertical direction to a firmed position against the underlying rail bed surface 76 and locked as adjusted. The foot 75 stabilizes the jack assembly 34 before, during and after the railroad car 20 is lifted.

As illustrated in FIGS. 4–7, the frame members 56 can be formed of two structural I-beams 77 held substantially parallel by laterally spaced apart end angles 78 and 79, a base plate 80, and cross members 90 and 91, each welded or otherwise secured to and between the I-beams 77. The lead end angle 78 may be oriented with its separate legs angled at 45 degrees relative to the beam, so that the inclined lower leg may help ride the suspended remote end of the frame members 56 onto the remote track rail 22, as the jack assembly 24 is being positioned from the opposite car side 55.

The pair of elongated frame members 56 are of a length sufficient to span between and beyond the track rails 22, and of sufficient strength, when spanned between the rails, to carry the load of the elevated railroad car 20. The base plate 80 is coupled to the bottom inward-facing flange of the I-beams 77.

A power lift means 38, illustrated as inflatable-deflatable bellows, is attached between the base plate 80 and a car engaging means 40. The power lift means 38 includes several toroidal-like sections that create a continuous generally cylindrical chamber. The car engaging means 40 is adapted to be moved by the power lift means 38 in a normal direction, toward or away from the frame members 56 and track rails 22.

The power lift means 38 can be adapted to receive an air line 50 in which pressurized air is introduced into the chamber. The bellows of the power lift means 38 are collapsible as the car engaging means 40 is lowered from a fully extended position. The chamber wall of the power lift means 38 is about one-half (½) inch thick, a sufficient thickness to withstand a maximum pressure within the chamber of about 125 psi. In the preferred embodiment, the bellows 38 is made of fiber-reinforced rubber, such as those produced by Firestone under the name AIRSTROKE® and Model No. 348-3 for industrial applications. Because of the flexibility of the power lift means 38 in a fully extended position, the car engaging means 40 would tend to slip thereby causing the power lift means 38 to buckle. Additional stabilizing means can be used to prevent the power lift means 38 from buckling. One skilled in the art can appreciate that the power lift means 38 can be made of a single bellows, multiple bellows, an airbag, or any type of air-filled structure sufficient to raise the car engaging means 40. It can also be appreciated by one skilled in the arts that such air-filled structures can be made of fabric, polymeric material, or any other material of sufficient strength to withstand the internal pressure during the lifting process.

In the preferred embodiment, the car engaging means 40 is a generally square steel plate. The dimensions of the car engaging means 40 is about 52 ft by 42 ft by 1 inch. When the power lift means 38 is in the collapsed position, the car engaging means 40 rests atop the frame members 56. One skilled in the art can appreciate that the car engaging means 40 can be made of any material sufficient to carry the load of a railroad car 20.

The power lift means 38 has a collar 109 that connects the power lift means 38 to the base plate 80 in an airtight manner. A collar 110 also connects the power lift means 38 to the car engaging means 40, thereby forming a seal at both ends of the power lift means 38. The base plate 80 is secured to the I-beams 77 by nut and bolt means 111.

A plurality of posts 60 are positioned surrounding the power lift means 38. The posts 60 are attached at the top to the car engaging means 40, and at the bottom to the base plate 80. The posts 60, illustrated as telescoping posts, provide lateral and rotational support to the car engaging means 40. The posts 60 follow the action of the car engaging means 40. In other words, the posts 60 extend when the car engaging means 40 is raised, and the posts 60 contract when the power lift plate is lowered. The posts 60 help stabilize the power lift means 38 as it is inflated and deflated to prevent the buckling as previously described.

In a preferred embodiment, four telescoping posts 60 are rigidly connected to the car engaging means 40 to help prevent buckling or sliding of the power lift means 38. The telescoping posts 60 are hollow concentric cylinders that slide vertically with respect to each other. The smallest inner cylinder attached to the car engaging means 40 and the largest outer cylinder attached to the base plate 80. The cylinders of the posts 60 are preferably made of steel. The largest cylinder of the posts 60 can have an outside diameter of about 6 inches, and a wall thickness of about one-half (½) inches. The smallest cylinder of the posts 60 can have an outside diameter of about two and a half (2½) inches, and a wall thickness of about one-quarter (¼) inches. One skilled in the art can appreciate that the posts can be made of a material of sufficient strength and rigidity to withstand the loads tending to cause rotational movement of the car engaging means 40.

As the car engaging means 40 is raised, each section of the telescoping posts 60 can slide relative to each other. Sufficient lubrication is provided to allow such a sliding motion. In a further embodiment, as the car engaging means 40 is raised, the smallest cylinder of the post 60 is extended fully before the next smallest cylinder can be extended. In another embodiment, all the cylinders of the posts 60 are free to extend and contract with respect to each other. Other structures that can be used to provide stability for the power lift means 38 while the car engaging means 40 is raised and lowered include: collapsible rails, scissor-like linkages, square tubing, rods, or hollow tubes. One skilled in the art can appreciate structures that can provide lateral and rotational stability to the power lift means 38.

A pair of rigid, panel-like support members 61 are positioned relative to the frame members 56, and are adapted to be pivoted about journals 62 between a raised position (illustrated in solid in FIG. 5) abutting stops 64 on the underside of the car engaging means 40, and a lowered position (illustrated in phantom in FIG. 5) aligned substantially parallel with the frame members 56. The support members 61, when in the raised position, provide a solid brace for supporting the car engaging means 40 and railroad car 20. This feature is effective as a safety device even in the event of failure of the power lift means 38. The journals 62 are rigidly connected to a cross member 91.

The support members 61 can be moved between the raised and lowered position by at least one power cylinder 65. Each power cylinder 65 is rotationally attached to a cross member 90 and a support member 61. In the preferred embodiment, each support member 61 is actuated by a pair of power cylinders 65. In the preferred embodiment, the power cylinders 65 are gas-powered struts.

A compressed-air delivery system 42 for activating the power lift means 38 and the power cylinders 65 is provided. The compressed-air delivery system 42 can include a compressor 43, control valves 44 and 46, and appropriate lines to connect these components to the power cylinders 65 and the power lift means 38. A handle 53 may be used to shift the control valves 44 and 46 between their operative positions. An internal combustion engine 54 may be used to drive the compressor 43. In the alternative, an electric or battery-powered motor can be used. Other types of pumping or air-delivery systems known in the art may be implemented. The components of the compressed-air delivery system 42 may be located laterally outside of or beyond one side 55 of the railroad car 20, and carried as a unitary part of the jack assembly 34. The control handle 53 may also be laterally beyond the side 55 of the railroad car 20, to be conveniently reached and shifted by someone standing at this location.

Each support member 61 is formed of a shaft 86 rotated within journals 62, and spaced arms 87 welded to the shaft 86. A face member 89, with a cambered edge to abut the car engaging means 40, is welded to and between the arms 87. The support member arms 87 are located laterally between the separate frame members 56, and the journals 62 are secured to a cross members 91. The cambered edge of the face member 89 is preferred, because it allows for a more stable connection between the face member 89 and the car engaging means 40. The cambered edge will abut the car engaging means 40, regardless of any possible angular rotation of the car engaging means 40.

The support member journals 62 are located laterally beyond the stops 64 of the car engaging means 40 and are generally evenly spaced therefrom. The support members 61 rotate upwardly about the journals 62 toward the stops 64 until the camber edge of the face member 89 abuts the car engaging means 40. This configuration mechanically locks the support members 61 in a raised bracing position against the car engaging means 40 and stops 64, independent of continued urging by the power cylinders 65 of the face members 89 against the stops 64. Thus, once the support members 61 are set in place, the jack assembly 34 may be supported by the support members 61 even without any pressure in either the power lift means 38 or the power cylinders 65.

The power cylinders 65 can be activated by the compressed-air delivery system 42 at the same time that the power lift means 38 is activated. Thus, as the power lift means 38 is being inflated, the support members 61 are being raised simultaneously. Final positioning occurs after the car engaging means 40 has reached full height. In an alternate embodiment, the power cylinders 65 can be activated after the power lift means 38 has been fully extended. Thus, once the railroad car frame 24 has been lifted above the wheeled truck assembly 26, the support members 61 are then raised to abut the car engaging means 40. In a further embodiment, there can be sensors that activate the power cylinders 65 once the car engaging means 40 reaches a predetermined height. The predetermined height can be measured either by the distance between the frame members 56 and the car engaging means 40, the distance between the railroad car frame 24 and the wheeled truck assembly 26, or any other measurement sufficient to remove or repair a wheeled truck assembly 26. It can be appreciated by those skilled in the art that the support members 61 can be rotated between a lowered and a raised position at different rates of angular rotation and the power cylinders 65 can be activated at any time during the raising and lower of the car engaging means 40.

The car engaging means 40 and the posts 60 are rigidly connected to the top surface of the power lift means 38. This allows the overlying frame 24 of the railroad car 20 to fit generally flat against the car engaging means 40 for effective load distribution. As the car engaging means 40 lifts the car frame 24, the weight of the railroad car 20 may urge the car engaging means 40 to rotate if it is not centrally positioned under the car or if the car has an uneven weight distribution. In other words, one edge of the car engaging means 40 may tend toward the ground while the opposing end tends away from the ground. This angular rotation of the car engaging means 40 is prevented by the rigid connection between the posts 60 and the car engaging means 40. Thus, the car engaging means 40 remains substantially parallel to the frame members 56. Due to the tremendous weight of a typical railroad car 20, it becomes important to surround the power lift means 38 with the posts 60.

A pressure line 50 is connected between the compressor 43 and an opening fluidly connected to the power lift means 38. Pressurized air is admitted to the chamber of the bellows 38 via line 50, actuating the power lift means 38 axially to an expanded configuration. Air pressure lines 48 connect the compressor 43 to the power cylinders 65 to actuate the support members 61 between the lowered and raised positions. Air or pressure regulators may also be installed so the bellows of the power lift means 38 is not damaged by over-inflation.

The compressed-air delivery system 42 is activated by moving the handle 53 between various positions. In the first position, the compressed-air delivery system 42 is off, whereby the valves 44 and 46 are closed and the engine 54 is off. In the second position, the valve 44 is opened and the compressor 43 is activated to allow pressurized air flow through line 50 in order to inflate the power lift means 38. In the third position, the valve 46 is opened to allow pressurized air to flow through lines 48 in order to activate the power cylinders 65, thereby rotating the support members 61 from a lowered position to a raised position. In the fourth position, the valve 46 is closed, the compressor 43 is inactive, and the valve 44 is opened so that air pressure within the power lift means 38 is released, thereby causing the power lift means to deflate. In the fifth position, the valve 44 is closed, the compressor 43 is inactive, and the valve 46 is opened so that air pressure within the power cylinders 65 is released, thereby causing the support members 61 to rotate from the raised to the lowered position. One skilled in the art can appreciate that other operating or control systems sufficient to power the jack assembly 34 can be used.

Operation of the Invention

The jack assembly 34 may first be located between the truck assemblies 26, typically closer to the truck assembly to be removed. The frame members 56 are sufficiently long to extend between and beyond the track rails 22, so as to lie across and over the rails. The height of the contracted jack assembly 34, between the bottom of the frame members 56 and the top of the car engaging means 40, is sufficiently small to fit within the clearance over the track rails 22 and under the car frame 24. Approximately 1–2 inches of clearance may be needed between the track rails 22, jack assembly 34 and the car frame 24, although a larger clearance of course could be possible.

The stroke of power lift means 38 may be between perhaps 10–25 inches, sufficient to lift the adjacent end of the railroad car frame 24 completely off of the adjacent wheeled truck assembly 26, while the other end of the frame 24 remains supported on the opposing wheeled truck 26.

After the jack assembly 34 has been positioned over the track rails 22 and under the railroad car 20, the handle 53 is in the off position, thereby closing the valves 44 and 46. The valve 46 is then shifted to the second position to open the valve 44, activate the engine 54 to power the compressor 53, and inflate the power lift means 38. The power lift means 38 is inflated until the railroad car frame 24 is spaced apart from the wheeled truck assembly 26 a desired distance.

Figure 5:
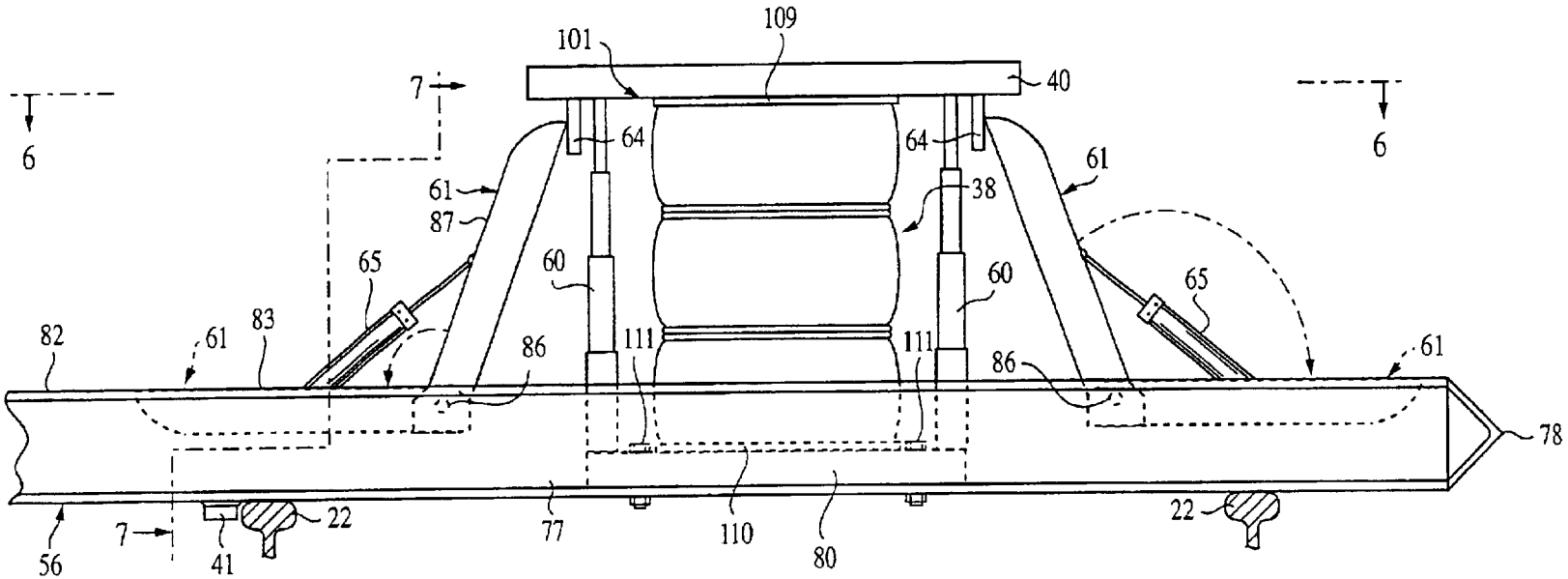
FIG. 5 is an enlarged side view similar to FIG. 3, illustrating a portion of the jack assembly.
Figure 6:
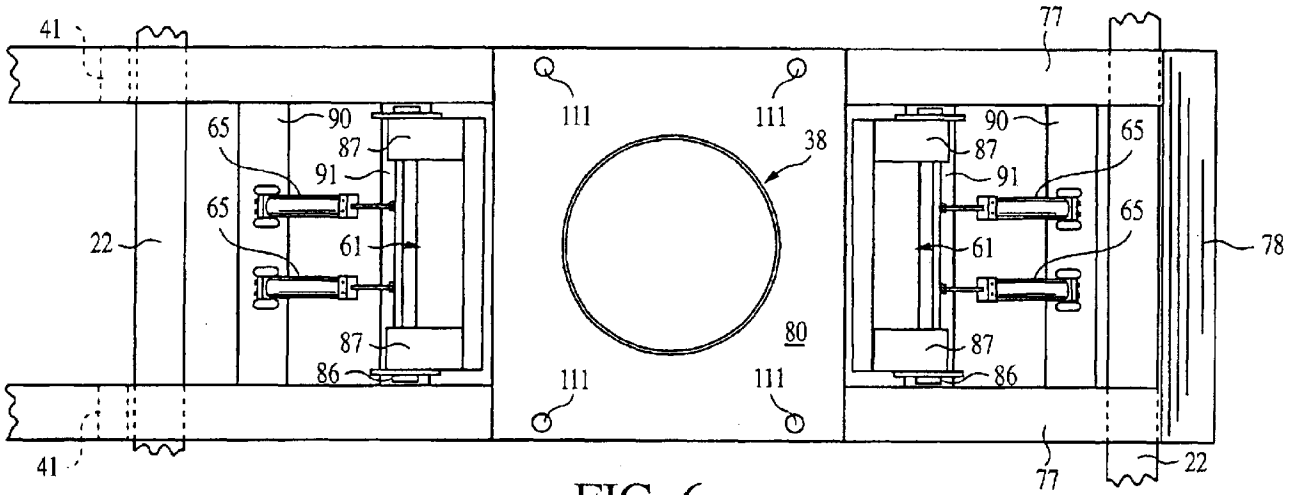
FIG. 6 is a top view of that portion of the jack assembly illustrated in FIG. 5.
Figure 7:
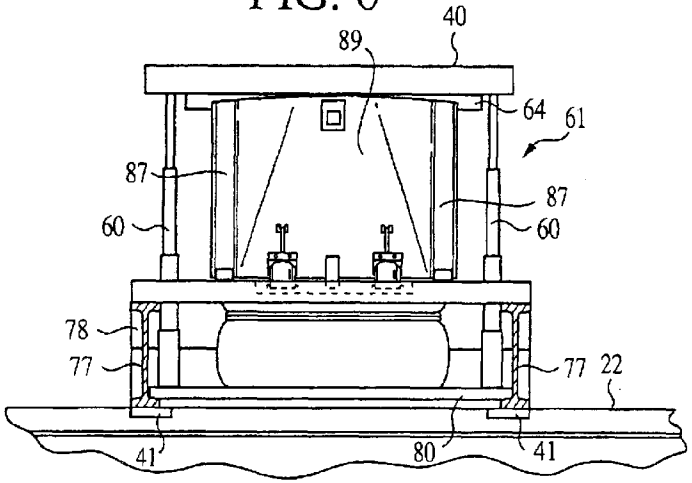
FIG. 7 is a sectional view, as taken generally from line 7—7 in FIG. 5.

In the fully inflated position of power lift means 38 as illustrated in FIG. 5, the support members 61 can be rotated to abut the stops 64. To operate the power cylinders 65, the handle 53 may be moved to the third position and the valve 44 may be returned to the closed position. Valve 46 is opened to allow air pressure to activate the power cylinders 65, and the support members 61 are raised against the lift plate stops 64, as illustrated in FIG. 5.

To set the raised jack assembly from the position illustrated in FIG. 5, some air pressure must be released from the power lift means 38 to lower the car engaging means 40 against the support members, as illustrated in FIG. 3. To do this, the pressure at line 50 is first dropped, such as opening valve 44 and stopping both the engine 54 and compressor 43. The valve 44 is shifted to the closed position when the car engaging means 40 has been lowered onto the cambered edge of the support members 61.

When blocked as illustrated in FIG. 3, the jack assembly 34 comprises a solid metal-to-metal triangulated support between the track rails 22 and elevated railroad car 20, independently of reduced air pressure in the power cylinders 65 or the power lift means 38. The underlying wheeled truck assembly 26 may then be separated from and rolled out from under the car, and be replaced with another truck assembly, or other servicing can now be done under the railroad car 20.

To remove the jack assembly from the lifting position illustrated in FIG. 3, the car engaging means 40 must first be raised again to the position of FIG. 5, to allow the support members 61 to be lowered. Valve 44 is opened and the engine 54 and compressor 43 are activated while the valve 46 remains closed. Once the car engaging means 40 is raised, valve 44 is closed, valve 46 is opened and the engine 53 and compressor 43 are turned off, thereby releasing the air pressure in the power cylinders 65 and lowering the support members 61. When the support members 61 have been lowered completely, valve 46 is again closed.

To lower the power lift means 38, the air pressure in line 50 must again be dropped, as noted above. The valve 44 is then shifted to an open position whereby the air pressure in the power lift means 38 is released. The load from the railroad car 20 on the car engaging means 40 forces the power lift means 38 downward.

When the valve 44 is opened to release the air pressure from the power lift means 38, the load from the car engaging means 40 (and possibly the railroad car 20) will force air out of the power lift means 38. Once the railroad car 20 has bottomed out onto the wheeled truck assembly 36, the weight of the car engaging means 40 will continue to force air out of the power lift means 38 until fully deflated.

When the power lift means 38 is completely deflated, the valve 46 may be shifted to the closed position, the engine 54 remains stopped, and the jack assembly 34 may be removed from under the railroad car 20.

The disclosed jack assembly 34 cooperates directly between the track rails 22 and the car frame 24 to provide a solid metal-to-metal braced support of the elevated railroad car without the need of auxiliary shoring. The triangulated support of the railroad car 20 on the jack assembly 34 between the two track rails 22 and the central sill 23 is stable enough to resist high crosswinds. The disclosed jack assembly 34 is relatively lightweight, capable of being moved about manually or with a small crane, truck lift or the like; and thereby is quite portable, for use at different sites. One person can use the jack assembly effectively and safely, and from only a single side of the railroad car.

Although the invention has been described with respect to specific illustrated embodiments, it should be understood that the invention is not limited to such embodiments. Additional modifications and/or additions may be included by those skilled in the art, without departing from the scope of the invention as defined by the following claims.

What is claimed is:

1. A railroad car jack assembly comprising:

a pair of spaced apart frame members having a top surface and a bottom surface, wherein said bottom surface of said frame members contact two laterally spaced railroad track rails to transfer the load received by said frame members to said railroad track rails;

a power lift means disposed between said frame member;

a car engaging means coupled to said power lift means for movement in the direction normal to said frame members;

said power lift means having an operative range of movement sufficient to move said car engaging means against a railroad car and then to elevate said railroad car to an elevated car retaining position; and, a plurality of posts arranged to surround said power lift means, wherein said posts are disposed between said frame members and provide lateral and rotational support for said car engaging means during operation of said power lift means.

2. The railroad car jack assembly of claim 1 further comprising a compressed-air delivery system configured to supply air pressure to said power lift means to inflate said power lift means.

3. The railroad car jack assembly of claim 2 wherein said power lift means comprises at least one air-operated bellows having a generally cylindrical shape upon inflation, said bellows arranged to provide a lifting force to said car engaging means.

4. The railroad car jack assembly of claim 3 wherein said bellows are constructed of a fiber-reinforced elastomeric material.

5. The railroad car jack assembly of claim 2 wherein said power lift means comprises a flexible airbag configured to receive pressurized air from the compressed-air delivery system, said flexible airbag arranged to providing a lifting force to said car engaging means.

6. The railroad car jack assembly of claim 1 wherein said car engaging means is a generally flat plate and has a generally square cross-section with respect to a horizontal plane.

7. The railroad car jack assembly of claim 6 wherein said posts are located near each corner of said plate.

8. The railroad car jack assembly of claim 7 wherein said posts are of a telescoping structure.

9. The railroad car jack assembly of claim 1 further comprising a plurality of support members which are actuated between a first position in which said support members are spaced away from said car engaging means and a second position in which an edge of said support members abuts said car engaging means.

10. The railroad car jack assembly of claim 9 wherein each of said support members are actuated between said first position and said second position by at least one fluid-operated power cylinder.

11. The railroad car jack assembly of claim 10 wherein said fluid is air.

12. The railroad car jack assembly of claim 10 wherein a sensor is configured to activate said at least one fluid-operated power cylinder when said car engaging means has reached said elevated car retaining position.

13. The railroad car jack assembly of claim 9 wherein said edge of said support members is cambered.

14. The method of lifting a railroad car comprising:

providing a railroad car jack having a pair of frame members, a power lift means, a car engaging means, and an air source operatively connected to said power lift means;

applying air pressure from said air source to said power lift means to raise said car engaging means; and, providing a plurality of posts, arranged to surround said power lift means, to support said car engaging means and to prevent lateral and rotational movement while raising said car engaging means.

15. The method of claim 14 wherein said posts are configured to extend in a telescoping manner while said car engaging means is raise.

16. The method of claim 15 further comprising rotating a plurality of support members between an inactive position in which the side member is spaced away from said car engaging means and an active position in which an edge of said support members abuts said car engaging means.

17. The method of claim 16 further comprising applying air pressure from said air source to an actuator to rotate said support members between said inactive position and said active position while said car engaging mean is being raised.

18. The method of claim 16 further comprising applying air pressure from said air source to an actuator to rotate said support members between said inactive position and said active position when said car engaging means has reached a predetermined height above said frame members.

19. A railroad car jack assembly comprising:

a pair of parallel frame members having a top surface and bottom surface, wherein said bottom surface of said frame members contact two laterally spaced railroad track rails to transfer the load received by said frame members to said railroad track rails;

an inflatable-deflatable bellows having a top mounting surface and a bottom mounting surface, wherein said bellows has a generally cylindrical shape upon inflation;

a plate disposed between said frame members, wherein said plate is coupled to said frame members and to said bottom mounting surface of said bellows;

a car engaging means coupled to said top mounting surface of said bellows for movement in a normal direction with respect to said frame members, said car engaging means being oriented in a substantially parallel relation to said frame members;

said bellows arranged to provide a lifting force to said car engaging means;

said bellows having an operative range of movement sufficient to move said car engaging means against a railroad car and then to elevate said railroad car to an elevated car retaining position;

a plurality of telescoping posts arranged to surround said bellows, wherein said telescoping posts are disposed between said frame members and provide lateral and rotational support for said car engaging means during operation of said bellows to maintain said car engaging means in substantially parallel relation to said frame members between said operative range of movement;

a pair of support members having a first edge and a second edge, wherein each of said support members is located on opposing sides of said bellows, and are disposed between said frame members;

said support members rotatable between a first position spaced away from said car engaging means and a second position in which said support members abut said car engaging means thereby providing support to said car engaging means;

said support members having a pair of air struts connected to each of said support members and configured to rotate said support members between said first position and said second position; and, an air source configured to supply air pressure to said bellows and said air struts, thereby activating said bellows and said air struts.

20. The method of lifting a railroad car comprising:

providing a railroad car jack having a pair of substantially parallel frame members, an inflatable-deflatable bellows, a car engaging plate couple to said bellows, and an air compressor operatively connected to said bellows;

providing a plurality of telescoping posts, arranged to surround said bellows for supporting said car engaging plate and to provide lateral and rotational stability while raising said car engaging plate;

providing a plurality of support members rotatable between a first position spaced away from said car engaging plate, and a second position in which said support members are in an abutting relationship with the car engaging plate for additional support;

providing at least one gas-powered strut coupled to each of said support members to actuate said support members between said first position and said second position;

applying air pressure from said air compressor to said bellows so as to create an upward force to said car engaging plate; and, applying air pressure from said air compressor to activated said gas-powered struts to rotate said support members between said first position and said second position.

* * * * *